US005749493A

United States Patent [19]

Boone et al.

[11] Patent Number: 5,749,493

[45] Date of Patent: May 12, 1998

[54] CONDUIT MEMBER FOR COLLAPSIBLE CONTAINER

[75] Inventors: Debra Cheryl Boone, Atlanta, Ga.; Mladomir Tomic, Appleton, Wis.

[73] Assignee: The Coca-Cola Company, Atlanta, Ga.

[21] Appl. No.: 119,034

[22] Filed: Nov. 10, 1987

Related U.S. Application Data

[63] Continuation of Ser. No. 542,322, Oct. 17, 1983, abandoned.

[51] Int. Cl.[6] ..... B65D 83/00

[52] U.S. Cl. ..... 222/105; 222/464.3

[58] Field of Search ..... 222/95, 105, 107, 222/92, 94, 183, 386.5, 464.1, 464.2, 464.3; 383/105, 35, 36, 119

[56] References Cited

U.S. PATENT DOCUMENTS

| | | | |
|---|---|---|---|
| 2,804,257 | 8/1957 | Hasler et al. | 383/36 |
| 2,891,700 | 6/1959 | Maynard | 222/92 |
| 3,090,526 | 5/1963 | Hamilton et al. | 222/105 |
| 3,361,303 | 1/1968 | Jacuzzi | 222/183 |
| 3,420,413 | 1/1969 | Corsette | 222/107 |
| 3,838,794 | 10/1974 | Cogley et al. | 222/95 |
| 3,981,415 | 9/1976 | Fowler et al. | 222/95 |
| 4,062,475 | 12/1977 | Harris et al. | 222/95 |
| 4,138,036 | 2/1979 | Bond | 222/464.3 X |
| 4,148,416 | 4/1979 | Gunn-Smith | 222/95 X |
| 4,159,790 | 7/1979 | Bailey | 222/464.2 X |
| 4,193,518 | 3/1980 | Holmes | 222/464.2 X |
| 4,270,533 | 6/1981 | Andreas | 222/95 X |
| 4,322,020 | 3/1982 | Stone | 222/105 X |
| 4,381,846 | 5/1983 | Heck | 222/105 |
| 4,524,458 | 6/1985 | Oangrass et al. | 222/105 X |
| 4,601,410 | 7/1986 | Bond | 222/105 X |
| 4,893,731 | 1/1990 | Richter | 222/105 X |

*Primary Examiner*—Kevin P. Shaver

*Attorney, Agent, or Firm*—Birch, Stewart, Kolasch & Birch, LLP

[57] ABSTRACT

A collapsible container comprising a flexible bag including a spout having an opening through which liquid is fed into and dispensed from the bag, and a liquid passage member inside of the bag in liquid communication with the spout opening for aiding in the dispensing of liquid from the bag. The liquid passage member is preferably integral with a wall of the bag.

20 Claims, 2 Drawing Sheets

CONDUIT MEMBER FOR COLLAPSIBLE CONTAINER

This application is a continuation of application Ser. No. 542,322, filed on Oct. 17, 1983, now abandoned.

BACKGROUND OF THE INVENTION

1. Field of the Invention

The present invention relates to collapsible sealed containers to dispense liquid products, and more particularly to a flexible conduit incorporated in such a collapsible container.

2. Description of the Prior Art

Many exemplary collapsible containers are available in the prior art which permit the extraction of the product from a container. Most of the containers use conventional dip tubes including an elongated cylindrical tube which includes an upper portion connected to a valve and a lower portion positioned within the product to be extracted from the container. For example, Daniels, U.S. Pat. No. 3,171,571 discloses a conventional bag-in-box type of dispensing package including a dip tube.

Another example of a dip tube position within a flexible bag is disclosed by Kramer, et al. U.S. Pat. No. 2,859,899. The dip tube includes perforations through which the syrup or other material positioned within the flexible bag is sucked therefrom by means of a pump. U.S. Pat. No. 4,286,636 to Credle discloses a collapsible bag with an extruded dip tube including at least one channel in the peripheral surface of the dip tube and extending along substantially the entire length of the dip tube. As a vacuum or suction is applied to the dip tube by a pump, initially all of the air within the collapsible bag is extracted therefrom. Subsequently, the liquid product is dispensed out of the collapsible bag and the bag collapses around a portion of the dip tube which is no longer surrounded by the liquid product.

One of the disadvantages of the prior art collapsible containers including dip tubes is that they require the insertion of a dip tube, and thus of an additional step in the manufacture of the filled container. Additionally, because of the geometry of the dip tube and the collapsible container, the insertion of the dip tube could not be handled through automated means, but rather requires manual insertion.

SUMMARY OF THE INVENTION

Accordingly, it is a primary objection of the present invention to provide an internal flexible conduit for a collapsible container comprising a pair of rib members extending along substantially the entire length of the collapsible container.

It is another object of the present invention to provide a conduit which can be integrally formed on the interior surface of the collapsible container.

A further object of the present invention is to provide a flexible conduit for a collapsible bag which can be inserted during the formation of the bag and requires no manipulative steps after filling of the collapsible container.

The objects of the present invention are fulfilled by providing at least one pair of flexible substantially parallel rib members disposed adjacent to an interior wall of the collapsible container. The flexible members are positioned within a collapsible bag a substantially adjacent to an annular spout member. Initially, air within the collapsible bag will be drawn therefrom. Subsequently, the liquid product disposed within the collapsible bag will flow through a channel formed by the adjacent ribs and the collapsible bag will collapse around the rib members. Progressively, as the liquid product is removed from the collapsible bag, the bag will continue to collapse around the rib members until all of the liquid product is dispensed therefrom.

A further aspect of the present invention is that the rib members can be disposed on a web which can be disposed between two flexible sheets which comprise a collapsible bag during the manufacture of the the bag. The major advantage of this development is that it avoids substantial manipulative steps both in the manufacture and assembling of the collapsible container and in the filling and use of the bag.

Further scope of applicability of the present invention will become apparent from the detailed description given hereafter. However, it should be understood, that the detailed description of the invention and the specific examples, while indicating preferred embodiments of the invention are given by way of illustration only, since various changes and modifications within the spirit of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

The present invention is directed to a collapsible container 10 which is used to dispense a liquid product therefrom. The collapsible container may be used in combination with a post-mix beverage system. Such a post-mix beverage system, which is hereby incorporated by reference, is disclosed in U.S. Pat. No. 4,014,461, issued Mar. 29, 1977 to Harvill and assigned to the same assignee as the present invention.

Figure 1:
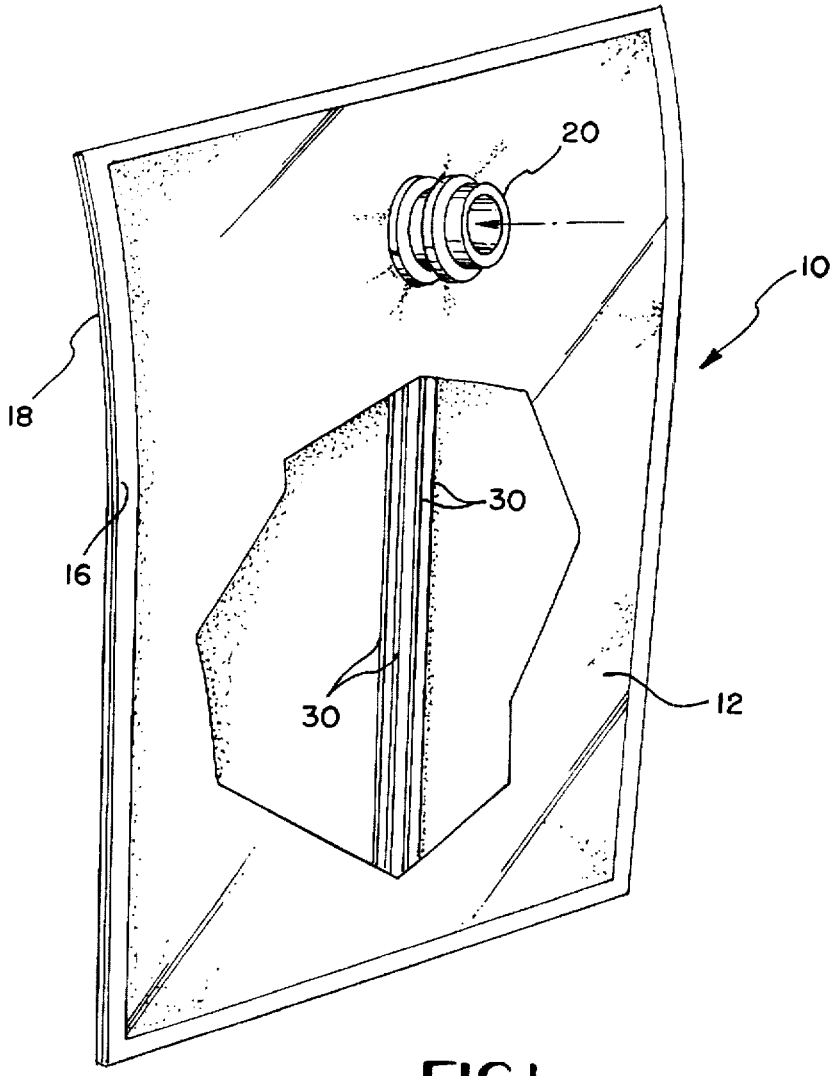
FIG. 1 is isometric, partially cut away front side view of a collapsible bag according to the present invention.
Figure 2:
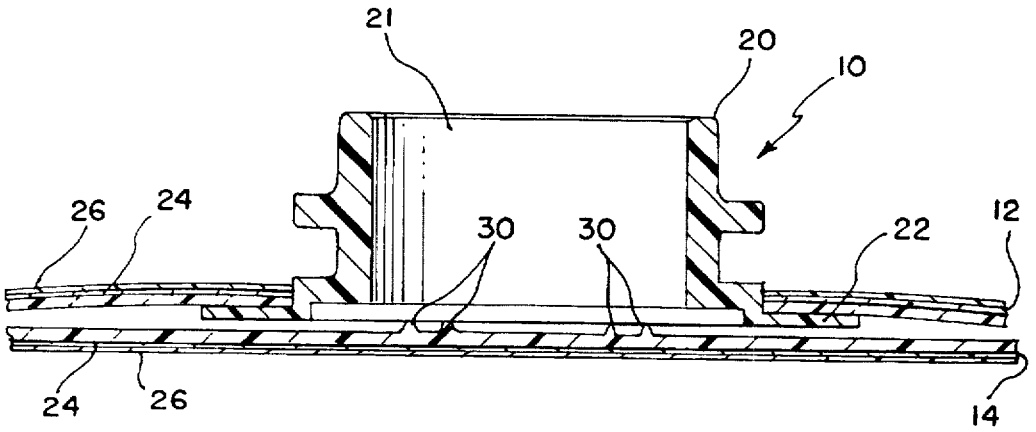
FIG. 2 is an enlarged cross sectional partial view of the collapsible bag including an annular spout adjacent to which are disposed a plurality of ribs according to the present invention.

As illustrated in FIGS. 1 and 2, the collapsible container 10 is made of a pair of sheets of flexible material 12 and 14 joined together at their respective peripheries 16 and 18. The flexible sheets are joined in a sealed relationship throughout the periphery and in the case of flexible sheets made of thermoplastic material, this may be a seal achieved by means of heat sealing or suitable adhesive. The collapsible bag 10 includes an annular spout, or bag fitment 20 disposed through the flexible sheet 12 and attached thereto by means of an annular flange 22. The annular spout 20 may be of any desired geometry which can be adapted to fit into a coupling for a suction system. Indeed as would be obvious to a person of ordinary skill in the art, the annular spout 20 may be any shape including non-annular. As shown in more detail in FIG. 2, the flexible sheets 12 and 14 may comprise a number of plys, e.g. 24 and 26. In the preferred embodiment, two plys are used. Ply 24 is a web of 2 mil. EVA disposed adjacent to second ply 26 which is a bonded web made up of the following three sheets: 2 mil. EVA, ½ mil. metalized PET, and a 2 mil. EVA.

The collapsible container 10 of the present invention includes at least one pair of ribs 30 disposed throuch the length of the collapsible container 10, shown in FIG. 1, and in relation to the annular spout 20 so that the pair of ribs 30 passes substantially adjacent to, and in line with the opening 21 of the annular spout 20. Although a pair of ribs is described, a single rib or protrusion 30 of sufficient height would be sufficient to achieve the objectives of the invention, although not as efficiently as a pain of ribs. The ribs 30 are slight protrusions which are closely spaced together. The ribs 30 may be extruded onto the flexible sheet 14, or in the case of a two ply sheet, on the inner layer 24.

In the preferred embodiment, the ribs 30 are disposed on the flexible sheet opposite to the flexible sheet where the annular spout 20 is attached. However, the present invention will also encompass the placement of the ribs on the flexible sheet on which the annular spout 20 is disposed, which although not as efficient, also can provide significant advantages over the system shown in the prior art.

Figure 3:
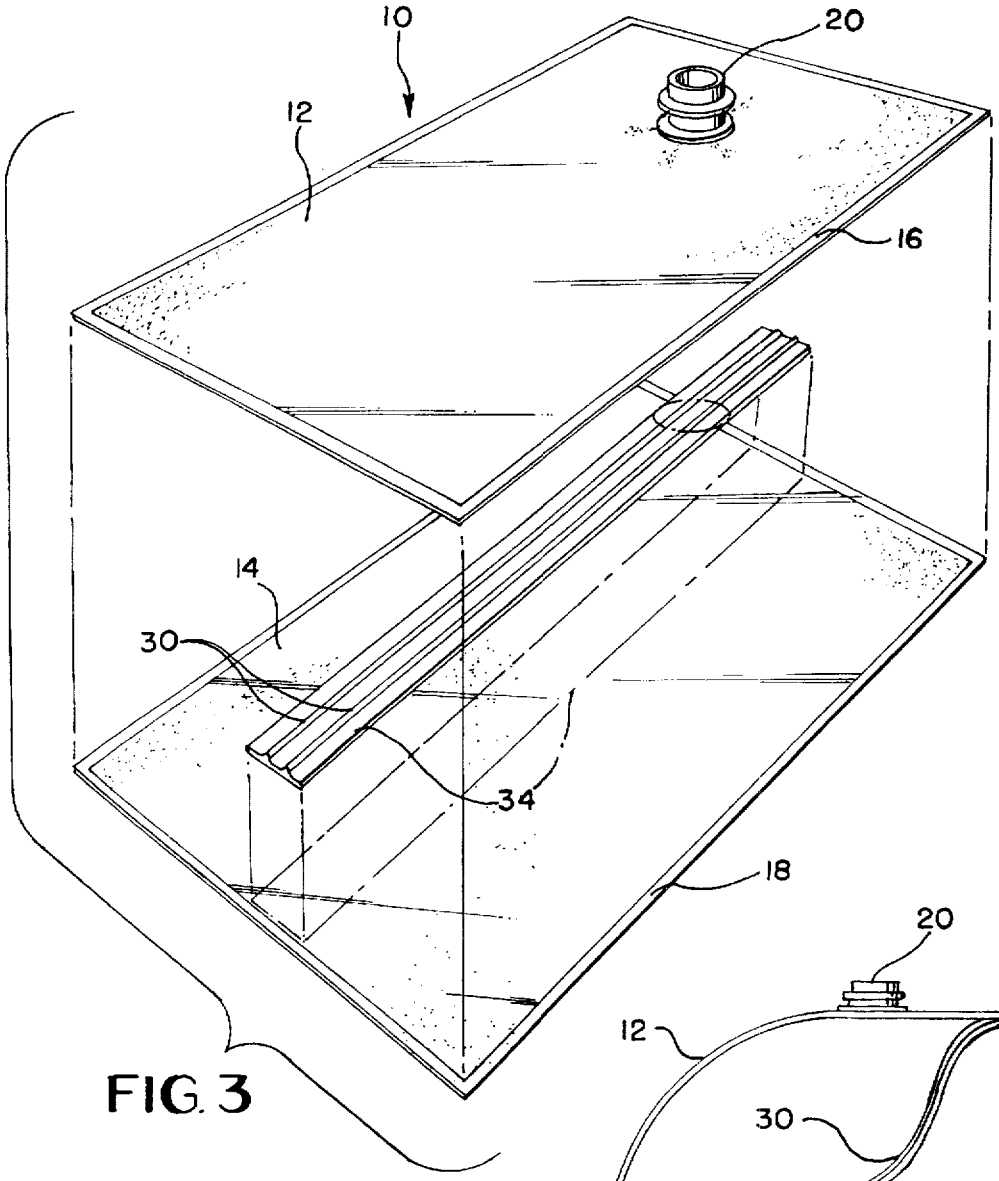
FIG. 3 is an exploded view of an embodiment of the present invention.
Figure 4:
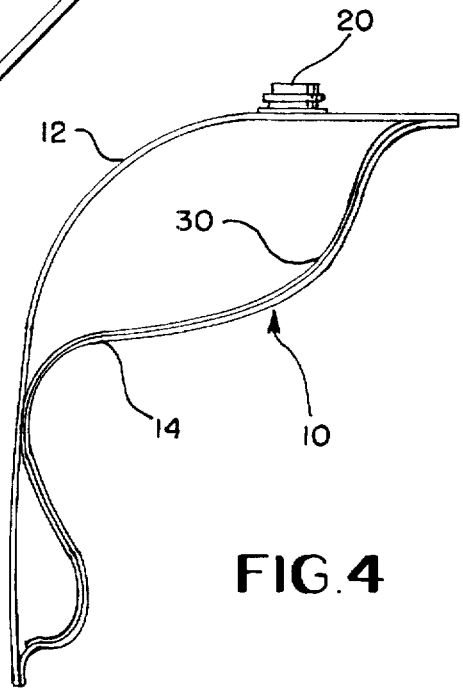
FIG. 4 is a lateral cross sectional view of a collapsible bag which illustrates the operation of the invention.

As illustrated in FIG. 3 another embodiment of the present invention includes a web strip 34 including at least one pair of ribs 30 disposed between the flexible sheets 12 and 14 and adjacent to, and in line with the annular spout 20. The web strip 34 should be made of compatible material with the flexible sheets 12 and 14. For example, if the interior ply of the sheets 12 and 14 is made out of EVA then the web strip 34 should be made of EVA or compatible material (e.g. low density polyethylene). The web strip 34 is attached to the flexible sheets 12 and 14 during the formation of the bag, when the adjacent sheets are secured at their periphery, thus, for example heat sealing of the adjacent flexible sheets 12 and 14 will also achieve the heat sealing and fixation of the flexible strip web 34. Illustrated in FIG. 4 is the operation of the ribs 30. As the flexible container 10 collapses, it has a tendency to collapse somewhat unevenly, leaving pockets of liquid which may become isolated from the rest of the liquid in the container. The ribs 30 form a conduit which cannot be closed off by the atmospheric pressure on the walls of the flexible sheets 12 and 14. Thus, the entire inner chamber of the flexible bag remains in communication with the spout 20 at all times during the operation.

The invention being thus described, it will be obvious that the same may be varied in many ways. Such variations are not to be regarded as a departure from the spirit and scope of the invention, and all such modifications as would obvious to one of ordinary skill in the art are intended to be included within the scope of the following claims.

What is claimed:

1. A method for producing a disposable flexible bag for use in containing and dispensing a liquid and including a spout having an opening through which the bag is to be filled and emptied, and said bag also including a liquid passage means inside of said bag for providing at least one elongated liquid channel open to the interior of said bag and in liquid flow communication with said spout opening as said bag progressively collapses against said liquid passage means, said method comprising the steps of:

a) providing flexible bag wall means for use in forming said bag;

b) providing a spout in said bag wall means having an opening therethrough and a longitudinal axis substantially perpendicular to said bag wall;

c) positioning said liquid passage means having said liquid channel inside of said bag wall means prior to forming said bag wall means into a bag;

d) positioning said liquid passage means inside of said bag wall means such that when said bag wall means are formed into a bag having no liquid contained therein, said liquid channel of said liquid passage means will be in liquid flow communication with said spout opening and transversely disposed thereto, substantially perpendicular to said longitudinal axis of said spout; and e) forming said bag wall means into a bag with said spout being connected through a bag wall, with said liquid passage means being secured inside of said bag to maintain said elongated channel in liquid flow communication with said opening in said spout.

2. The method as recited in claim 1 wherein said step of positioning said liquid passage means inside of said bag wall means comprises positioning, inside of said bag wall means, a flat, elongated, flexible member having a liquid channel extending along its length, said liquid channel being open to the interior of said bag along its length.

3. The method as recited in claim 2 including the step of positioning said member between a pair of bag wall means and directly underneath said spout, prior to forming said bag wall means into a bag.

4. The method as recited in claim 3 including the step of connecting said member in place in said bag by heat sealing.

5. The method as recited in claim 4 wherein said bag is formed by heat sealing and including the step of heat sealing said member in place simultaneously with forming said bag by heat sealing.

6. The method as recited in claim 5 including the step of heat sealing said member to said bag wall means.

7. The method as recited in claim 1 wherein said liquid passage means is a flat, flexible member.

8. The method as recited in claim 7 wherein said member is narrow and elongated.

9. The method as recited in claim 1 wherein said member includes means for defining said liquid channel and for preventing said bag wall means from blocking liquid flow through said liquid channel when said bag wall means has collapsed against said member.

10. A method for producing a disposable, flexible bag for use in containing and dispensing a liquid, comprising the steps of:

a) providing a pair of rectangular bag walls;

b) heat sealing a spout having a longitudinal axis and a spout opening therethrough to one of said bag walls with the longitudinal axis thereof substantially perpendicular to said bag wall;

c) positioning a flexible, flat, narrow, elongated liquid passage member separate from said bag walls, between said pair of bag walls and adjacent to said spout prior to the complete sealing of said bag walls together to form said bag, said member having liquid passage means thereon for providing at least one liquid channel therealong open to the interior of said bag and in liquid flow communication with said spout opening as said bag empties and progressively collapses against said member, said member also including means for preventing said bag walls from blocking said liquid channel when said bag wall collapses against said member;

d) heat sealing said walls together to form said bag with said member positioned in-between said walls; and e) heat sealing said member in place inside of said bag with said channel transversely disposed of said spout opening and substantially perpendicular to said longitudinal axis of said spout when said bag is in an unfilled condition.

11. The method as recited in claim 10 wherein said member heat sealing step comprises heat sealing said member in place simultaneously with the step of heat sealing at least a portion of said walls together to form said bag.

12. The method as recited in claim 10 wherein said member heat sealing step comprises heat sealing said member to at least one of said walls.

13. A disposable, flexible bag for use in containing and dispensing a liquid comprising:

a) a pair of rectangular bag walls heat sealed together at their peripheries to form a flat rectangular unfilled bag;

b) a spout having a longitudinal axis and a spout opening therethrough and heat sealed to one of said bag walls with said longitudinal axis substantially perpendicular to said bag wall;

c) a flexible, flat, narrow, elongated liquid passage member, separate from said bag walls, and positioned inside of said flat bag and having liquid passage means thereon for providing at least one liquid channel therealong open to the interior of said bag; and d) said liquid passage member being heat sealed in place inside of said bag and being located in liquid flow communication with and transversely of said spout opening.

14. A disposable, flexible bag for use in containing and dispensing a liquid, said bag being flat in an unfilled condition thereof, comprising:

a) a bag having a bag wall;

b) a spout having a spout opening therethrough attached to said bag wall and having a longitudinal axis substantially perpendicular to said bag wall; and c) an elongated fluid passage member secured inside of said bag and having at least one open fluid passageway therealong in liquid communication with said spout opening, said member lying substantially flat within a flat bag wall when the bag is empty and before it is filled with liquid, said fluid passageway being transversely disposed across said spout opening substantially perpendicular to the longitudinal axis of said spout before said bag is filled with liquid and being open to the interior of said bag along its length and having a depth and a width such that as the bag wall collapses against said member during withdrawal of liquid from the bag, the bag wall cannot extend into and block said passageway, such that the passageway remains open to permit complete withdrawal of liquid from the bag.

15. The article of claim 14, wherein said elongated member includes at least one pair of spaced-apart ribs defining said fluid passage.

16. The article of claim 15, wherein said ribs are parallel to each other and extend in a straight line between the ends of said member and across said spout opening when said bag is in an empty, pre-filled condition.

17. The article of claim 15, wherein said ribs are integral with the bag wall opposite said spout opening.

18. The article of claim 14, wherein at least one end of said member is heat sealed in the bag.

19. The article of claim 14, wherein the bag wall includes two separate bag walls with their peripheral portions heat sealed together.

20. The article of claim 14, wherein said spout is heat sealed to the bag wall.

* * * * *